US005107766A

United States Patent [19]

Schliesske et al.

[11] Patent Number: 5,107,766

[45] Date of Patent: Apr. 28, 1992

[54] FOLLOW-THRU GRENADE FOR MILITARY OPERATIONS IN URBAN TERRAIN (MOUT)

[76] Inventors: Harold R. Schliesske, 227 Walnut St., Westfield, N.J. 07090; deceased William Moscatiello, late of Rockaway; by Caroline Moscatiello, Administratrix, 8 Carla Ct., Rockaway, both of N.J. 07866

[21] Appl. No.: 735,547

[22] Filed: Jul. 25, 1991

[51] Int. Cl.[5] ..... F42B 15/00

[52] U.S. Cl. ..... 102/373; 102/473; 102/478; 102/479; 102/482

[58] Field of Search ..... 102/308, 372, 373, 437, 102/473, 476, 478, 479, 482

[56] References Cited

U.S. PATENT DOCUMENTS

| | | | |
|---|---|---|---|
| 1,270,322 | 6/1918 | Quartieri et al. | 102/479 |
| 4,063,512 | 12/1977 | Davis | 102/476 |
| 4,803,928 | 2/1989 | Kramer et al. | 102/476 |
| 4,967,666 | 11/1990 | Kellner et al. | 102/476 |

FOREIGN PATENT DOCUMENTS

| | | | |
|---|---|---|---|
| 2552870 | 4/1985 | France | 102/476 |
| 10980 | of 1884 | United Kingdom | 102/479 |
| 1051407 | 12/1966 | United Kingdom | 102/476 |

*Primary Examiner*—Harold J. Tudor

[57] ABSTRACT

A follow-thru grenade for military operations in urban terrain uses a microsecond delay fuzed warhead to breach a target will to allow a deflector protected anti-personnel millisecond delay fuzed grenade to proceed through the wall breach to attach enemy personnel behind the wall.

6 Claims, 1 Drawing Sheet

FOLLOW-THRU GRENADE FOR MILITARY OPERATIONS IN URBAN TERRAIN (MOUT)

GOVERNMENTAL INTEREST

The invention described herein may be manufactured, used and licensed by or for the Government for Governmental purposes without the payment to us of any royalties thereon.

BACKGROUND OF THE INVENTION

Military Operations in Urban Terrain (MOUT) have shown the necessity of combating enemy personnel hidden behind brick, concrete, or wood walls which protect them from current infantry weapons. In the past, when operating in a MOUT environment, which included enemy troops positioned in buildings protected by walls, in order to neutralize the effectiveness of these enemy troops required a two-step approach. First, the attacking force outside of the building had to first breach the wall for access and then proceed to introduce an anti-personnel charge or grenade into the interior. This approach for attacking such protected enemy requires two successful operations with the last operation being particularly hazardous.

Light weight recoiless guns firing high explosive plastic HEP) warheads are suitable for breaching the walls but fail to deliver a munition capable of surviving the intense warhead blast and then detonate behind the breached wall. The intensity of the warhead blast usually destroyed or severely deformed most projectile components designed to provide anti-personnel effects.

SUMMARY OF THE INVENTION

The present invention relates to a follow-thru munition capable of surviving an intense warhead blast and then detonating behind the breached wall. The present invention allows one projectile to perform two highly desirable functions of breaching a wall and simultaneously incapacitating enemy personnel positioned behind a wall.

The primary objective of the present invention is to provide a munition for a recoiless gun capable of breaching a building wall and simultaneously deliver a follow-thru anti-personnel grenade to incapacitate personnel positioned behind that wall.

The present invention allows one projectile to perform both breaching and anti-personnel functions.

For a better understanding of the present invention, together with other and further objects thereof, reference is made to the following descriptions taken in connection with the accompanying drawings.

BRIEF DESCRIPTIONS OF THE DRAWINGS

Throughout the following description, like reference numerals are used to denote like parts of the drawings.

DETAILED DESCRIPTION OF THE PREFERRED EMBODIMENTS

Figure 1:
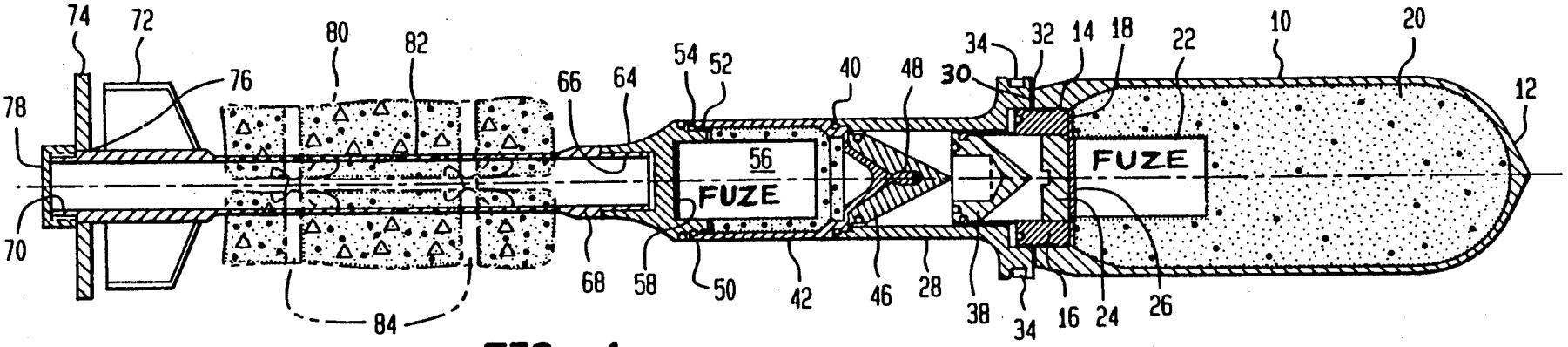
FIG. 1 is longitudinal diametral cross-sectional view of a cartridge incorporating the follow-thru grenade for Military Operations in Urban Terrain (MOUT).
Figure 2:
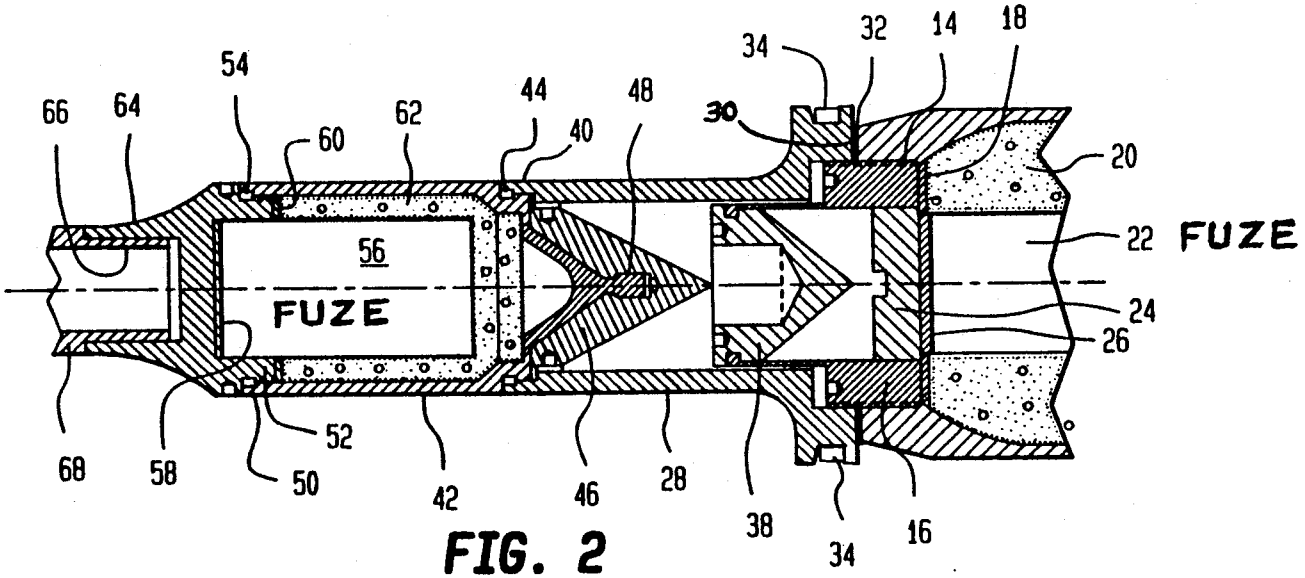
FIG. 2 is an enlarged section of the grenade body assembly, adapter and standoff shown in FIG. 1.

Referring now to FIGS. 1 and 2, a cylindrically shaped warhead casing 10 has a blunt front end 12 and an internally threaded rear end 14. A hollow tee-shaped internally externally threaded standoff adapter member 16 is threadedly attached to the warhead rear end 14. A felt pad ring 18 is operatively disposed intermediate the front face of standoff adapter 16 and the explosive charge 20 of warhead 10. A primary warhead fuze 22 is axially disposed in the rear end of the warhead 10 and operatively affixed thereto. A fuze plug 24 is threadedly torqued into the forward end of the standoff adapter 16. A felt pad 26 is operatively disposed intermediate plug 24 and the warhead fuze 22. A hollow cylindrical standoff 28 is threadedly attached to standoff adapter 16 on its outer forward end 30. A gasket 32 is operatively positioned intermediate the forward end 30 of the standoff 28. A ring shaped obturator 34 is positioned in an obturator groove 36. A hollow conically-shaped forward deflector 38 is threadedly disposed in the rear end of the standoff adapter 16. The rear end 40 of the standoff member 28 is internally threaded and threadedly coupled to the front section of the hollow cylindrical grenade body 42, and is in axial alignment therewith. A first O-Ring 44 is disposed intermittent the standoff rear end 40 and the front section of grenade body 42. A second conically-shaped deflector member 46 is operatively fixed in front of the conical front end 48 of the grenade body 42. The rear end 50 of the grenade body 42 is internally threaded. An externally threaded grenade closure forward end member 52 is threadedly attached to the grenade body rear end 50. A second O-Ring 54 is operatively disposed intermediate the rear end grenade closure 52. The warhead gasket 32 and the O-Rings 44 and 54 are to ensure that potentially hazardous propellant gases do not leak into the projectile during launch. Contained within grenade body 42 and grenade closure 52 is a grenade fuze 56 which is separated from the grenade closure by a felt pad 58. A felt ring 60 separates the rear end of the closure 52 and a hollow cup-shaped grenade explosive 62 encloses the fore end of the fuze 56 and fills a portion of the front cavity of the grenade body 42. The hollow rear end 64 of the grenade closure 52 is threadedly attached to the forward end 66 of a cylindrical boom member 68. The threaded rear end 70 of the boom member supports a fin assembly 72 and a blow out disc 74. Blow out disc 74 is fixedly held against boom shoulder 76 by a cap igniter 78. A propellant charge 80 is operatively positioned around a necked down boom section 82 by strap ties 84.

In operation, the projectile is launched against its target from a light weight recoiless gun, not shown, when the cap igniter causes the propellant charge 80 to ignite. Upon impact with the target wall the front end 12 of the warhead 10 begins to deform or "squash". Sensing the rapid deceleration caused by impact with the wall, the warhead fuze 22 and the grenade fuze 56 each begin their own predetermined functioning sequence. The warhead fuze 22 initiates a "super quick" mode which results in warhead 10 detonation in several microseconds. Simultaneously, the grenade fuze 56 initiates a slower "delay" mode scheduling grenade explosive 62 detonation to occur in several milliseconds after the warhead 10 has detonated. The intense rearward blast of the warhead 10 is initially absorbed by the solid frontal mass of the stand off forward end 30 and then diverted around the grenade body 42 by the forward deflector member 38 and the second deflector member 46. The forward momentum of the grenade body 42, still undetonated, carries it through the hole in the target wall produced by the warhead 10. With a suitable delay time designed into the grenade fuze 56, the intact grenade 42 now passes through the breached target wall and detonates several feet beyond one wall scattering anti-personnel fragments throughout the area. Enemy personnel positioned behind the wall thus have now been subjected to the initial breaching blast of the warhead 10 followed immediately by the incapacitating blast and resulting fragments from an anti-personnel grenade.

While a specific embodiment of the invention has been shown and described in detail to illustrate the application of the principles of the invention, it will be understood that the invention may be embodied otherwise without departing from such principles.

What is claimed is:

1. A recoiless, follow-thru munition for use in breaching target wall in urban terrain, said munition comprising:

warhead means for penetrating said target wall, said warhead means comprising a warhead casing filled with an explosive charge and further comprising a first fuze means operable to detonate said explosive charge upon rapid compression of said warhead casing;

hollow, cylindrical standoff means threadedly coupled said warhead means, said cylindrical standoff means comprising first felt pad means behind said first fuze means, a fuze plug means behind said first felt pad means, and a standoff adapted means threadedly attached to said fuze plug means within said cylindrical standoff means, said standoff adapter means further supporting a first deflector means in said cylindrical standoff means which comprises a hollow conical means to absorb and deflect a rearward explosive blast from said warhead means;

second deflector means further supported within said cylindrical standoff means and behind said first deflector means comprising a hollow conical means to further absorb and deflect rearward explosive blast from said warhead means, a gasket operatively positioned intermediate said cylindrical standoff means and said warhead casing and a felt ring means position intermediate said adapter standoff means and said warhead explosive charge;

grenade means threadedly attached in axial alignment with said cylindrical standoff means, comprising a grenade to delay fuze means operative to detonate said grenade means at a fixed time following detonation of said first fuze means; and boom means threadedly coupled in axial alignment with said grenade means, said boom means supporting a fin assembly means for guiding said munition in-flight toward said target wall, and a concentric cylindrical propellant charge for propelling said munition towards said target wall, and a second felt pad means behind said grenade fuze means.

2. A munition as recited in claim 1 wherein said adapter standoff means includes a hollow tee-shaped member having an internally disposed threaded surface therein and an externally threaded surface.

3. A munition as recited in claim 2 wherein said standoff means includes:

a hollow cylindrical member having an internally threaded rear end;

a threaded forward end having an obturator groove peripherally disposed therein; and a ring-shaped obturator operatively disposed in said obturator groove.

4. A munition as recited in claim 3 wherein said grenade means includes:

a hollow cylindrical grenade body member having a conically-shaped front end and an internally threaded open rear end;

a closure member having an externally threaded forward end threadedly connected to said hollow cylindrical body rear end and a hollow internally threaded rear end.

5. A munition as recited in claim 4 wherein said boom means includes:

a threaded forward end which is threadedly coupled to said internally threaded closure rear end;

a necked down boom section in axial alignment with said closure rear end;

said propellant charge operatively wrapped around said necked down boom section;

an externally threaded hollow boom rear end in alignment with said necked down boom section;

said fin assembly means operatively disposed on said boom rear end;

a blow-out disc proximately positioned adjacent to said fin assembly; and an igniter cap threadedly connected to said boom rear end of igniting said propellant charge.

6. A munition as recited in claim 5 wherein said first fuze means has a delay mode in the range of microseconds and said grenade time delay fuze means has a delay mode in the range of milliseconds.

* * * * *